US005755566A

United States Patent [19]

Marsillo et al.

[11] Patent Number: 5,755,566

[45] Date of Patent: May 26, 1998

[54] SELF-DRIVING FLUID PUMP

[75] Inventors: Julio Marsillo, Montreal; Graham L. Lewis, Beaconsfield, both of Canada

[73] Assignee: Kalish Canada Inc., Canada

[21] Appl. No.: 702,839

[22] Filed: Aug. 23, 1996

[51] Int. Cl.[6] ..... F04C 2/18; F04C 13/00

[52] U.S. Cl. ..... 418/200

[58] Field of Search ..... 418/200

[56] References Cited

U.S. PATENT DOCUMENTS

| | | | |
|---|---|---|---|
| 2,382,042 | 8/1945 | Etnyre | 418/200 |
| 2,750,891 | 6/1956 | Berry | 418/200 |
| 3,272,140 | 9/1966 | Curry et al. | 418/200 |
| 4,277,230 | 7/1981 | Muller | 418/200 |
| 4,776,779 | 10/1988 | Crump | 418/200 |
| 4,907,954 | 3/1990 | Slupski | 418/200 |
| 5,092,751 | 3/1992 | Viktora | 418/1 |

FOREIGN PATENT DOCUMENTS

| | | | |
|---|---|---|---|
| 150499 | 8/1882 | France | 418/200 |
| 973994 | 8/1960 | Germany | 418/200 |
| 2020008 | 11/1971 | Germany | 418/200 |
| 53-139206 | 12/1978 | Japan | 418/200 |
| 324979 | 2/1930 | United Kingdom | 418/200 |

*Primary Examiner*—John J. Vrablik

*Attorney, Agent, or Firm*—Ladas & Parry

[57] ABSTRACT

A pump suitable for use with delicate fluids such as food products. The pump includes a casing having an internal cavity that defines a pumping chamber, an inlet and an outlet port, a first and second pumping rotors mounted for rotation in the casing, each pumping rotor including a first set of angularly spaced apart projections and a second set of angularly spaced apart projections. The first and second sets of projections of one rotor are in a condition of mesh with the first and second sets of projections of the other rotor, respectively. This feature allows one rotor to drive the companion rotor, thus eliminating the need of separate drive gears.

14 Claims, 3 Drawing Sheets

SELF-DRIVING FLUID PUMP

FIELD OF THE INVENTION

The invention relates to a pump designed for pumping viscous and delicate materials, such as food products that may contain chunks of solid particles. More particularly it relates to a pump which includes pumping wheels with projections defining between them pockets for trapping and transporting fluid between an inlet port and an outlet port, the projections being in a condition of mesh to establish a driving relationship between them, whereby rotary movement communicated to one pumping wheel is transmitted via the meshing projections to the other pumping wheel. The invention also extends to a novel rotor assembly particularly well suited for use in pumps designed for delicate materials.

BACKGROUND OF THE INVENTION

A so called lobe pump comprises a pumping chamber in which are mounted two rotors including a plurality of meshing lobes. The rotors turn in opposite directions defining between adjacent lobes inter-lobe cavities or pockets that can trap and transport material from the inlet port to the outlet port of the pump. This type of pump is used for pumping highly viscous materials that may contain chunks of solid particles. A typical example would be food products such as relish, mayonnaise, mustard and salsa among others. In those applications it is critical to use a pump that transports the material by gentle pumping action to avoid any damage resulting from excessive agitation. If the pump is incorrectly designed the transported fluid will be subjected to levels of milling action that produce high shearing stress and high pressures. Such mechanical working of the pumped material is detrimental in the case of delicate substances, such as mayonnaise that can be degraded to the point where it is no longer suitable for human consumption. In the case of products containing chunks of solid or semi-solid particles, such as relish or salsa, the intense mechanical working has the effect of shredding the solid particles which degrades the texture of the product. To avoid such difficulties lobe pumps for food products or other delicate fluids are designed with inter-lobe pockets that can transport relatively large volumes of product at a time and, thus, avoid the milling action arising when the inter-lobe pockets are small. In addition, the geometry of the mechanical parts of the pump are designed to limit as much as possible the shearing action and pressures to which the transported fluid is subjected. The requirement of large inter-lobe pockets limits the number of individual lobes on each rotor. It's for this reason that on currently available pumps for food products the number of lobes on each rotor is usually limited to four.

Conventional lobe pumps are gear-driven devices. Each lobe rotor is coupled to a gear which meshes with the gear of the other rotor. Rotary movement is communicated to one gear through any convenient agency. That rotary movement is then communicated to the other rotor through the gear mesh arrangement. The requirement for using separate drive gears in order to impart rotary movement to the lobe rotors of the pump arises from the fact that the lobes on each rotors cannot act as gears by themselves. This is due to the fact that only a few lobes are provided on each rotor which is largely insufficient to effect rotary movement transmission from one rotor to the other. Consider for example a pump having two four-lobed rotors where driving force is communicated by an external agency to one rotor only. Theoretically, that rotor (driving rotor) will be able to drive the other rotor (driven rotor) when one lobe of the driving rotor causes a corresponding lobe of the driven rotor to turn over an angular sector of at least 90 degrees. If this was accomplished, then a proper driving engagement would be maintained such that one rotor could drive the other and at the same time the rotors would remain in a timed relationship so each lobe would face a corresponding inter-lobe cavity and thus avoid jamming. The problem, however, is that each lobe is not capable of driving a corresponding lobe over an angular sector of 90 degrees. Typically, best which can be accomplish is perhaps 45 degrees or somewhat more, but not the 90 degrees required. As a result, one rotor will drive properly the other rotor over a limited angular sector but, at some point the condition of mesh will be lost and the two rotors will jam.

A possible solution to this problem is to provide each rotor of the pump with a greater number of lobes in order to avoid the presence of "dead sectors" where the condition of mesh between two lobes is lost. Consider, for example the U.S. patent Curry et al. U.S. Pat. No. 3,272,140, entitled "METERING PUMP", discloses a split spur gear pump. This patent discloses a pump structure using rotors with radially arrayed projections that drive one another and at the same time the inter-projection pockets transport fluid from the inlet to the outlet. The object of the invention is to provide a positive displacement pump with a substantially constant flow output stream. More specifically, the pump is comprised of a first pair of pumping wheels mounted on a common axle and a second pair of pumping wheel also mounted on a common axle and meshing with respective wheels of the first pair. The projections of the pumping wheels in each pair are angularly displaced by one-fourth pitch which enables to reduce the flow pulsations.

The Viktora U.S. Pat. No. 5,092,751, entitled "SPLIT PUMP MECHANISM WITH GEAR OFFSET", discloses a similar system. The principal object of this invention is to provide a split gear pump apparatus which minimizes pulsations per pump revolution to an insignificant level. This invention is very similar to the invention described in the Curry et al. patent except that there is no separator plate between each pair of pumping wheels.

The Curry and the Vickora patents discussed above may not require separate drive gears since the number of projections on the rotors mounted in the pump housing is sufficient to avoid any dead sectors. Those pumps, however, are not well suited for use with delicate fluids such as food products because the larger number of projections is likely to subject the pumped fluid to an excessive milling action. Thus, there is a need in the industry to provide a pump for use with delicate fluids and where the rotors are capable of driving one another, thus avoid the requirement of separate drive gears.

OBJECTIVE AND STATEMENT OF THE INVENTION

An object of the present invention is to provide a pump that overcomes or at least alleviates the deficiencies associated with prior art devices.

It is another object of the present invention to provide a pump suitable for use with delicate fluids such as food products, where one pumping rotor is capable to drive the companion pumping rotor and thus eliminate the need of separate drive gears.

A further object of the invention is to provide a pump that is of simple construction, easy to clean and maintain sanitary requirements and inexpensive to manufacture.

Yet, a further object of the invention is to provide an improved rotor for a pump suitable for use with delicate fluids such as food products.

As embodied and broadly described herein, the invention provides a pump comprising:

a casing having an internal cavity that defines a pumping chamber;

an inlet port for admitting fluid in said pumping chamber;

an outlet port for discharging fluid from said pumping chamber;

a first and second pumping rotors mounted for rotation in said pumping chamber about spaced apart rotation axes, each pumping rotor including a first set of angularly spaced apart projections located in a generally common plane and a second set of angularly spaced apart projections located in a generally common plane, the projections of said first set being axially spaced apart with relation to the projections of said second set;

the first set of projections on one of said rotors being in a condition of mesh with the first set of projections of the other of said rotors and the second set of projections on one of said rotors being in a condition of mesh with the second set of projections of the other of said rotors;

each projection on one of said rotors being capable of imparting a rotary movement to a corresponding projection on the other one of said rotors over an angular sector a that is less than N/360 degrees, where N is the number of projections in each set of projections;

the projections of the first set and the projections of the second set on each rotor being angularly offset with relation one another such that during a complete revolution of each rotor a timing between said rotors is continuously maintained.

In a most preferred embodiment of the present invention the novel pump includes four pumping wheels arranged in pairs on two parallel axles. Each pumping wheel includes four projections shaped as lobes characterized by an arcuate outer profile substantially free of sharp edges in order to minimize the milling action and pressure exerted on the pumped fluid. The wheels on a given axle are angularly offset by approximately 45 degrees. This arrangement allows to continuously preserve the timing between the pumping wheels despite of the fact that a single lobe can drive a corresponding lobe from an opposite wheel over an angular sector which is much less than 90 degrees. Since the total number of lobes per axle is doubled by comparison to a single pumping wheel and the lobes are offset angularly, each lobe needs to drive a corresponding lobe over a much smaller angular sector (45 degrees). Such 45 degrees of drive path can be easily accomplished without the need of increasing the number of lobes per wheel. As a result, the inter-lobes distance can be maintained sufficiently large to avoid damaging sensitive fluids.

To drive the pump it thus suffices to impart rotary movement to one of the rotors through a coupling connecting a prime mover, such as an electric motor to the shaft of the wheel. The rotary motion will be transmitted to the other rotor through the arrangement of meshing projections. This structure is much simpler than prior art pumps since the conventional drive gears provided to drive and preserve the timing of the pumping wheels are no longer required.

In a variant a separator plate is mounted between each pair of pumping wheels so as to isolate the pumping chamber in two separate cavities. Under such form of construction, the pump actually operates as a pair of separate pumping devices connected in parallel and sharing a common inlet port and an outlet port. The advantage of the separator plate is to further reduce the milling action and pressure exerted on the pumped fluid. Indeed, the shearing action that may occur between axially offset lobe sets from wheels mounted on different axles is avoided by the use of such separator plate preventing the pumped fluid from traveling between the pumping wheel layers. Also, in eliminating the cross leakage between the pumping wheel layers, the separator increases the pump efficiency in terms of pressure and displacements.

As embodied and broadly described herein, the invention further provides a pump comprising:

a casing having an internal cavity that defines a pumping chamber;

an inlet port for admitting fluid in said pumping chamber;

an outlet port for discharging fluid from said pumping chamber;

a first and second pumping wheels mounted for rotation in said pumping chamber about a generally common rotation axis;

a third and fourth pumping wheels mounted for rotation in said pumping chamber about a generally common rotation axis, said first pumping wheel being meshed with said third pumping wheel and said second pumping wheel being meshed with said fourth pumping wheel;

each said pumping wheel including a plurality of angularly spaced apart projections defining therebetween inter-projection pockets for transporting fluid in said pumping chamber between said inlet port and said outlet port;

each projection of said first wheel being capable of driving a corresponding projection of said third wheel over an angular sector that is less than N/360 degrees where N is the number of projections on said first wheel;

each projection of said second wheel being capable of driving a corresponding projection of said fourth wheel over an angular sector that is less than M/360 degrees where M is the number of projections on said second wheel;

the projections of said first and second wheels being angularly offset from one another; and the projections of said third and fourth wheels being angularly offset from one another.

As embodied and broadly described herein the invention further provides a rotor for use in a pump including a pumping chamber and inlet and outlet ports opening in the pumping chamber, said rotor including:

a first set of projections angularly spaced apart from one another, said first set of projections being located generally in a common plane that is transverse to a rotation axis of said rotor;

a second set of projections angularly spaced apart from one another, said second set of projections being located generally in a common plane that is transverse to the rotation axis of said rotor and being axially spaced from said first set of projections;

two of said rotors being capable of establishing together a condition of mesh in which a projection of said first set of one rotor is capable of driving a projection of the first set of the other rotor over an angular range a that is less than N/360, where N is the number of projections in said first set;

said second set of projections being angularly offset with relation to said first set of projections and providing means for when two of said rotors are meshed together preserve a timing between the rotors during a complete revolution of each rotor.

Other objects and features of the invention will become apparent by reference to the following specification and to the drawings.

BRIEF DESCRIPTION OF THE DRAWINGS

A detailed description of preferred embodiments of the invention are provided herein with reference to the following drawings, in which.

Figure 1:
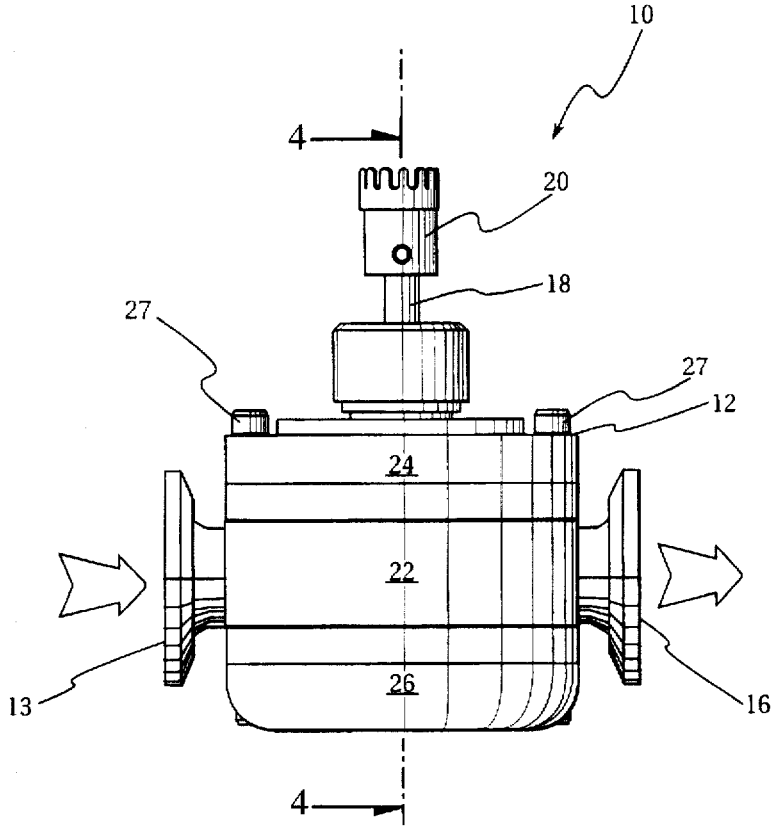
FIG. 1 is a side elevation view of a pump constructed in accordance with the invention.

In the drawings, preferred embodiments of the invention are illustrated by way of example. It is to be expressly understood that the description and drawings are only for the purpose of illustration and as an aid to understanding, and are not intended as a definition of the limits of the invention.

DESCRIPTION OF PREFERRED EMBODIMENTS

Referring now to the drawings, FIG. 1 illustrates a pump constructed in accordance with the present invention that is particularly well suited for pumping delicate substances such as food products, namely mayonnaise, mustard, relish and salsa among other. It should be pointed out, however, that the pump can also be used for transporting other fluids or substances without departing from the spirit of the invention.

The pump designated generally by the reference numeral 10 includes a housing 12 that is preferably made of stainless steel to be compatible with regulations concerning the handling of food products. From the housing 12 projects an inlet port 13 through which material is admitted to the pump and an outlet port 16 for discharging the pumped material. On the top part of the housing 12 is provided a drive shaft 18 carrying a suitable coupling 20 for connection to an electric motor (not shown in the drawings). The electric motor is provided to impart rotary movement to the shaft 18 in order to drive the internal pumping mechanism, as it will be described below.

The housing 12 includes a central portion 22 that is integrally formed with the inlet port 13 and with the outlet port 16. A top cover 24 and the bottom cover 26 are mounted on respective sides of the central section 22 by using suitable fasteners such as bolts 27. The top cover 24 differs from the bottom cover 26 by the provision of an aperture to accommodate the rotary shaft 18. This arrangement allows the pump 10 to the easily disassembled, simply by removing the bolts 27 in order to gain access to the internal mechanism for cleaning or maintenance.

Figure 2:
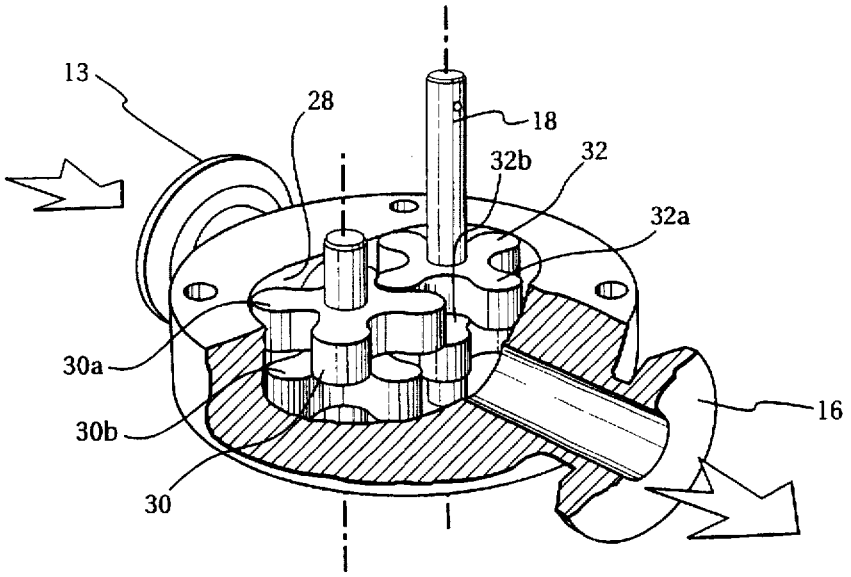
FIG. 2 is a perspective view of the pump with a portion broken away to illustrate the pumping wheels configuration.
Figure 3:
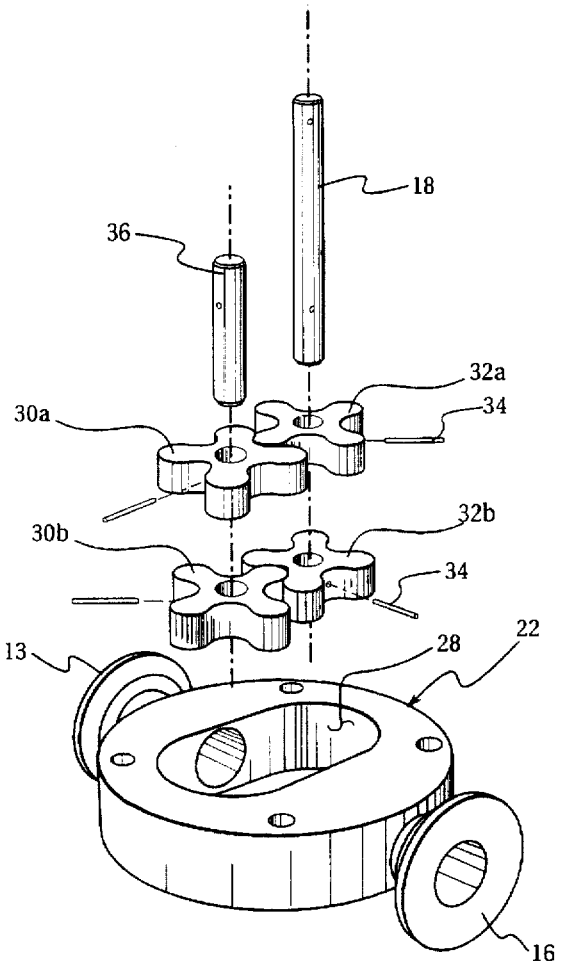
FIG. 3 is a perspective exploded view of the pump.
Figure 4:
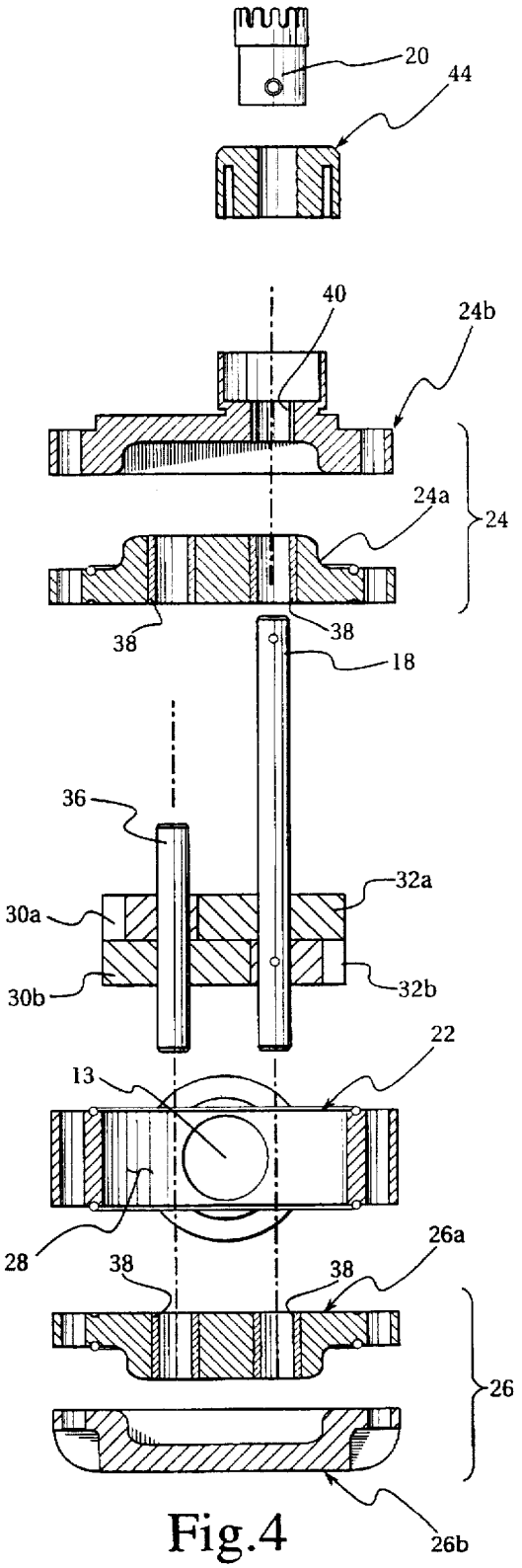
FIG. 4 is a sectional view taken along lines 4—4 of FIG. 1.

With reference to FIGS. 2, 3 and 4 the central section 22 of the pump housing is provided with an internal race track shaped cavity forming a pumping chamber 28. Both the inlet and the outlet ports 13, 16 open in the pumping chamber 28 as is best shown at FIGS. 2 and 3. The pumping chamber 28 receives two rotors 30 and 32 that transport material from the inlet port 13 to the outlet port 16. Each rotor comprises a pair of pumping wheels. For ease of reference the pumping wheels of a given rotor will be designated by the reference numeral of that rotor followed by the suffixes a and b. As best shown in FIGS. 3 and 4 the pumping wheels 32*a* and 32*b* are mounted on the drive shaft 18 and keyed with pins 34 that lock the wheels on the shaft against any rotational or axial movement thereon. Similarly, the pumping wheel wheels 30*a* and 30*b* are keyed on an idler shaft 36 that is somewhat shorter than the drive shaft 18. The coupling 20 is secured to the upper extremity of the rotary drive shaft 18 by any appropriate means.

The drive shaft 18 and the idler shaft 36 are mounted for rotation in respective bushings 38 held in the top cover 24 and the bottom cover 26. FIG. 4 reveals that actually the top and the bottom covers 24 and 26 are formed of two components namely bushing plates 26*a* and 24*a* holding the bushings 38 and cover plate elements 26*b* and 24*b*. As briefly mentioned earlier, the cover plate element 24*b* is provided with an aperture 40 through which the drive shaft 18 extends. A seal cap 44 is placed on the shaft 18 to prevent egress of fluid from the pumping chamber.

As in the case of the housing 12, the rotors 30 and 32, the shafts 18 and 36 and their associated components are made of stainless steel.

Figure 5A:
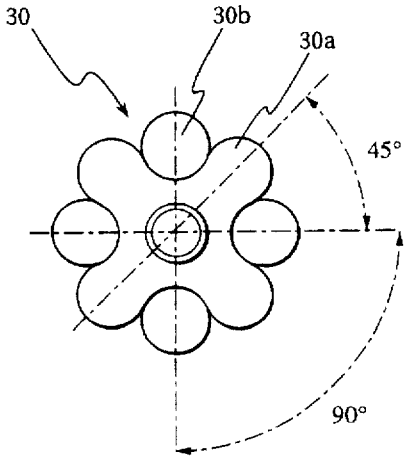
FIG. 5*a* is a plan view of two superposed pumping wheels having four lobes each.
Figure 5B:
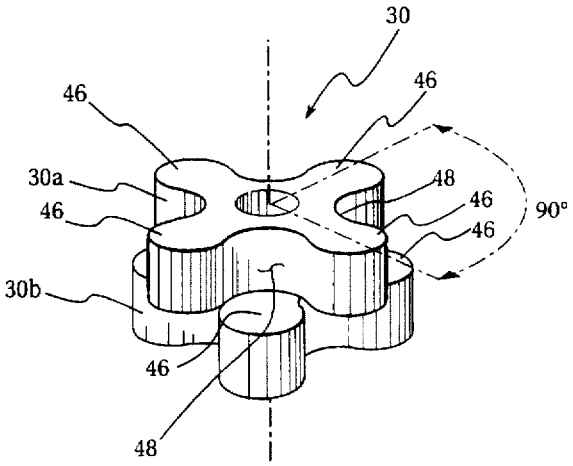
FIG. 5*b* is a perspective view of the pumping wheels shown in FIG. 5*a;*

FIGS. 5*a* and 5*b* illustrate with greater detail the structure of the rotors 30 and 32. The drawings show only the structure of one rotor, it being understood that the other rotor is identical. Each pumping wheel 30*a* and 30*b* includes four radially projecting lobes 46 substantially free of sharp edges whose center lines are located at 90 degrees angular intervals. In use (refer to FIG. 3) the meshed rotors 30 and 32 are caused to turn in opposite directions, rotor 32 rotating clockwise as seen from top. This causes the pockets defined between the inter-lobe cavities 48 to travel along the hemispherical segments of the pumping chamber 28. Fluid enters the pumping chamber 28 through the inlet port 13 and fills the inter-lobe cavity 48 which at that time faces the inlet port. As the rotors turn, that inter-lobe cavity traps the fluid and displaces the fluid along the wall of the pumping chamber 28. As such, the fluid is caused to travel toward the output port 16. As the inter-lobe cavity 48 reaches the outlet port 16 the lobe 46 from the companion rotor begins penetrating the inter-lobe cavity which causes the fluid therein to be expelled through the outlet port 16. This pumping cycle is repeated four times at every revolution of each pumping wheel.

A critical aspect of the invention resides in the indexing of the pumping wheels as shown at FIGS. 5*a* and 5*b*. More specifically, the lobes 46 of each pumping wheel are angularly offset such that their center lines are shifted 45 degrees apart. This feature allows to establish a driving relationship between the rotors 30 and 32 while, maintaining the inter-lobe cavities 48 large enough to avoid subjecting the pumped fluid to an excessive milling action. The profile of each lobe 46 is such that the lobe can drive a corresponding lobe from the companion rotor over an annular sector that slightly exceeds 45 degrees. Thus, a driving relationship between rotors including only one pumping wheel made of four projecting lobes 46 is not possible since past the 45 degrees driving sector of each lobe a slippage between the meshing lobes will occur. As a result, the driving wheel will continue rotating over a short angular sector without, however, causing the rotation of the driven wheel. This causes the wheels to lose their timing and jam. Proper rotation can be effected only if the lobes can drive corresponding lobes over an annular sector of at least 90 degrees (for a pumping wheel having four lobes). This, however, is not possible or practical. The invention solves this problem by providing on each rotor a second pumping wheel, offset with relation to the first wheel such that the drive sectors of each lobe add to one another to make up the 360 degrees without any dead sectors where the driving relationship and timing between the pumping wheels is lost. Thus, it suffices to impart rotary movement to one rotor only (in the example shown through the drive shaft 18) in order to operate the pump. Rotary movement to the other rotor is transmitted through the arrangement of meshing lobes. Due to the presence of two pumping wheels on each rotor no dead sectors exist and the timing between the rotors can be preserved.

The angular offset between the lobes of the pumping wheels in a given rotor can vary depending upon the extent of the drive sector of each lobe. In the example shown at FIGS. 5*a* and 5*b* it was assumed that each lobe can drive a corresponding lobe over a sector of approximately 45 degrees. As such, the lobes must be arrayed such that one sector begins where the previous sector ends, otherwise dead sectors will arise. If the drive sectors are extended beyond 45 degrees such precise positioning is no longer necessary. Consider for example an embodiment where each lobe has a driving capability over a sector of 50 degrees. The lobes of the pumping wheels need no longer be arrayed such that the center line of each lobe is precisely in the middle of the annular sector defined between lobes that belong to the companion pumping wheel. A deviation from such middle point is possible up to the extent where no dead sectors are created between the lobes.

Figure 7:
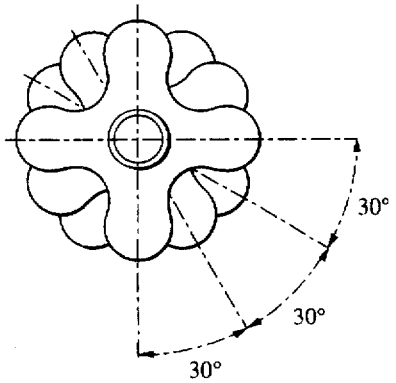
FIG. 7 is a plan view of three pumping wheels constructed in accordance with a variant.

In a variant the rotor configuration shown in FIG. 7 can be used. This embodiment features three pumping wheels stacked on a common axis, each wheel including four lobes. Due to the presence of the third wheel the lobes between adjacent wheels need the offset only by an annular sector of 30 degrees. This embodiment is suitable for applications where it is desirable to configure the lobes such that their individual driving sectors drop below 45 degrees. It should also be pointed out that the embodiment of FIG. 7 has the advantage of reducing the pump pulsations since the various inter-lobe cavities that transport fluid overlap with one another and thus deliver the fluid lower more steadily without sharp pulsations.

In a further variant, not shown in the drawings each rotor can be made as a single unit rather than beings assembled from a plurality of pumping wheels. Under this form of construction the rotor includes a number of integrally formed lobe groups axially displaced from one another. Objectively, this form of construction is not optimal as such rotor is difficult to manufacture. Nevertheless, this structure is a distinct possibility under the present inventive concept.

Figure 6:
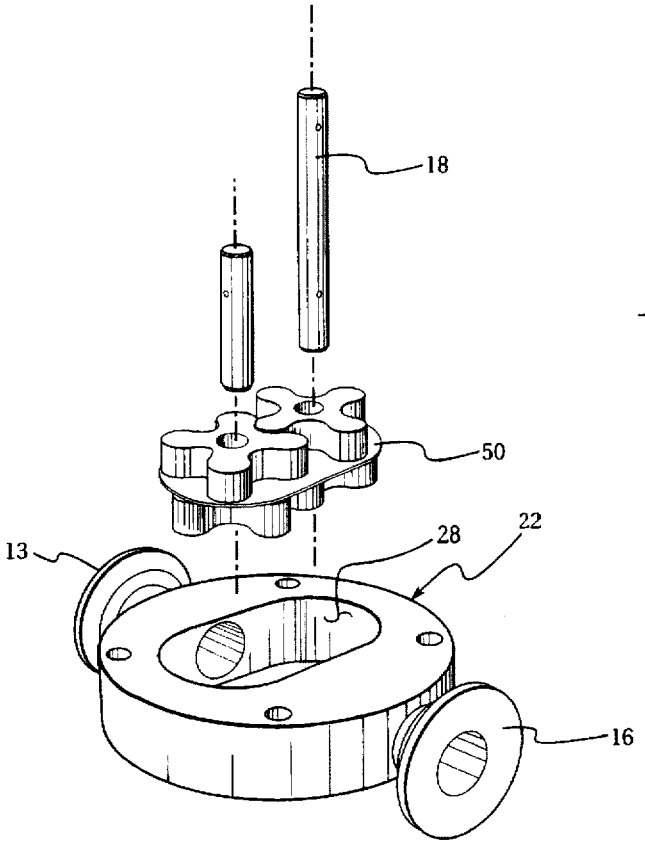
FIG. 6 is a perspective exploded view of the pump in accordance with a variant, featuring a separator plate between the pumping wheel layers.

A further variant of the invention is illustrated in FIG. 6 of the drawings. The characterizing element of this embodiment is the provision of a separator plate 50 mounted between the pumping wheels of each rotor in order to further reduce the milling action exerted on the pumped fluid. The separator plate 50 has the effect of transforming the pump into two separate pumping devices operating in parallel and sharing common inlet and outlet ports. Thus, the stream of fluid delivered from the inlet port 13 into the pumping chamber 28 is split in two and the first half passes over the separator plate 50 where it is transported by the pumping wheels 30*a* and 32*a* toward the outlet port 16. The other half of the stream passes under the separator plate and it is transported by the pumping wheels 30*b* and 32*b*. The separator plate 50 limits the flow of fluid between the pumping wheel layers to reduce or substantially eliminate the shearing action produced when lobes of diagonally opposed pumping wheels (wheel 30*a* and wheel 32*b*, for example) slide past one another. Such shearing action may have the effects of locally increasing the pressure in the fluid or shredding solid or semi solid substances which, as discussed earlier is not desirable. Also, in eliminating the cross leakage between the pumping wheel layers, the separator 50 increases the pump efficiency in terms of pressure and displacements.

The separator plate 50 is made of stainless steel and it is mounted between the pumping wheels of the rotors, provision being made for circular apertures of sufficient diameter to allow passage of the drive shaft 18 and the idler shaft 36 such that no interference arises with the material of the plate. Such floating plate arrangement is advantageous in that it facilitate the complete disassembly of the pump for cleaning or maintenance. However, it may be envisaged to weld or otherwise secure the separator plate 50 in the pumping chamber 28.

The above descriptions of preferred embodiments should not be interpreted in any limiting manner since variations and refinements are possible which are within the spirit and scope of the present invention. The scope of the invention is defined in the appended claims and their equivalents.

We claim:

1. A pump comprising a casing having an internal cavity that defines a pumping chamber; an inlet port for admitting a fluid in said pumping chamber; an outlet port for discharging the fluid from said pumping chamber; and a pumping arrangement including a plurality of pumping wheels, each having a plurality of angularly spaced apart projections defining therebetween inter-projection pockets for transporting the fluid in said pumping chamber between said inlet port and said outlet port, said projections being shaped as lobes substantially free of sharp edges, wherein the plurality of pumping wheels include a first pair of pumping wheels with a first and second pumping wheels mounted for rotation in said pumping chamber about a first common rotation axis, and a second pair of pumping wheels with a third and a fourth pumping wheels mounted for rotation in said pumping chamber about a second common rotation axis, said first pumping wheel being meshed with said third pumping wheel and said second pumping wheel being meshed with said fourth pumping wheel, and wherein each pumping wheel includes four lobes of projections, the projections of said first and second wheels being angularly offset from one another, and the projections of said third and fourth wheels being approximately equally angularly offset from one another.

2. A pump as defined in claim 1, wherein each projection on said first and second pairs of pumping wheels includes a center line that extends radially from the respective common rotation axis on which the pumping wheels are mounted, the center lines of the projections of each pumping wheel being angularly offset from each other.

3. A pump as defined in claim 1, wherein the projections of said first wheel are angularly offset with relation to the projections of said second wheel such that a projection of said first wheel is located between two projections of said second wheel.

4. A pump as defined in claim 1, wherein the projections of said first wheel are angularly offset with relation to the projections of said second wheel such that a projection of said first wheel is located at a mid-point between two projections of said second wheel.

5. A pump as defined in claim 1, wherein said first and second pumping wheels are mounted on a common drive shaft that coincides with the first common rotation axis and projects outside said pumping chamber.

6. A pump as defined in claim 5, further including a coupling mounted to said drive shaft for connecting said drive shaft.

7. A pump as defined in claim 1, further including a separator plate mounted between said first and third pumping wheels on one hand and the second and fourth pumping wheels on the other hand, said separator plate inhibiting flow of the fluid in said pumping chamber along a direction generally parallel to the common rotation axes of said pumping wheels.

8. A pump comprising a casing having an internal cavity that defines a pumping chamber; and inlet port for admitting a fluid in said pumping chamber; an outlet port for discharging the fluid from said pumping chamber; a pumping arrangement comprising a first and second pumping rotors mounted for rotation in said pumping chamber about spaced apart rotation axes, each pumping rotor including a first set of angularly spaced apart projections located in a first generally common plane and a second set of angularly spaced apart projections located in a second generally common plane, the projections of said first set being axially spaced apart with relation to the projections of said second set; the first set of projections on one of said rotors being meshed with the first set of projections of the other of said rotors and the second set of projections on one of said rotors being meshed with the second set of projections of the other of said rotors; wherein said projections are shaped as lobes substantially free of sharp edges, the projections of the first set and the projections of the second set on each rotor being approximately equally angularly offset with relation to one another such that during a complete revolution of each rotor a timing between said rotors is continuously maintained, and wherein each said rotor includes a pair of pumping wheels, one of the pumping wheels including said first set of projections and the other of said pumping wheels including said second set of projections, each pumping wheel including four lobes of projections.

9. A pump as defined in claim 8, wherein each projection includes a center line that extends radially on the rotor on which the projection is mounted, the center lines of the projections of said first set are angularly offset with relation to the respective center lines of the projections of said second set by approximately 45 degrees.

10. A pump as defined in claim 8, wherein the projections of said first set are angularly offset with relation to the projections of said second set such that a projection of said first set is located between two projections of said second set.

11. A pump as defined in claim 8, wherein the projections of said first set are angularly offset with relation to the projections of said second set such that a projection of said first set is located at a mid-point between two projections of said second set.

12. A pump as defined in claim 8, wherein one of said rotors includes a drive shaft projecting outside said pumping chamber.

13. A pump as defined in claim 12, further including a coupling mounted to said drive shaft for connecting said drive shaft to a prime mover.

14. A pump as defined in claim 8, further comprising a separator plate mounted between said pumping wheels on each rotor, said separator plate inhibiting flow of the fluid in said pumping chamber along a direction generally parallel to said rotation axes of said rotors.

* * * * *

UNITED STATES PATENT AND TRADEMARK OFFICE

CERTIFICATE OF CORRECTION

PATENT NO. : 5,755,566

DATED : May 26, 1998

INVENTOR(S) : Julio MARSILLO et al

It is certified that error appears in the above-identified patent and that said Letters Patent is hereby corrected as shown below:

| | |
|---|---|
| Col. 8, line 54 | after "another" insert --, one of said pairs of pumping wheels being adapted for being driven by a driving means and the other pair of pumping wheels being driven by said one pair of pumping wheels--; |
| Col. 9, line 19 | delete "and" and insert --an--; |
| Col. 10, line 7 | after "projections" insert --, one of said rotors, being adapted for being driven by a driving means and the other rotor being driven by said one rotor--. |

Signed and Sealed this

Seventeenth Day of November, 1998

*Attest:*

Bruce Lehman

BRUCE LEHMAN

*Attesting Officer*

*Commissioner of Patents and Trademarks*